US011559834B1

(12) United States Patent
Smith

(10) Patent No.: US 11,559,834 B1
(45) Date of Patent: Jan. 24, 2023

(54) SQUARE TUBING SWAGER

(71) Applicant: Charter M. Smith, Calgary (CA)

(72) Inventor: Charter M. Smith, Calgary (CA)

( * ) Notice: Subject to any disclaimer, the term of this patent is extended or adjusted under 35 U.S.C. 154(b) by 0 days.

(21) Appl. No.: 17/681,822

(22) Filed: Feb. 27, 2022

(51) Int. Cl.
*B21D 41/04* (2006.01)
*B21D 19/10* (2006.01)

(52) U.S. Cl.
CPC ..... *B21D 41/04* (2013.01); *B21D 19/10* (2013.01)

(58) Field of Classification Search
CPC ..... B21D 19/10; B21D 41/04; B21C 5/003; B21J 9/06
USPC ..... 72/370.12, 370.13, 370.26, 402
See application file for complete search history.

(56) References Cited

U.S. PATENT DOCUMENTS 771,921 A * 10/1904 McGovern ..... B30B 7/04 72/402
3,059,510 A * 10/1962 Appel ..... B21J 7/145 72/402
3,246,502 A * 4/1966 Brignoli ..... B21C 5/003 72/402
3,303,681 A * 2/1967 Le Fiell ..... B21J 7/14 72/402
3,893,327 A * 7/1975 Fedorov ..... B21D 41/04 72/402
4,461,163 A 7/1984 Kralowetz
5,078,002 A * 1/1992 Bozzi ..... B21J 7/46 72/402
5,230,352 A * 7/1993 Putnam ..... B21F 15/00 223/102
6,464,588 B1 10/2002 Rupp
7,013,550 B2 3/2006 Shinjo
8,516,871 B2 8/2013 Weber et al.
8,869,583 B2 10/2014 Meiners et al.
10,177,517 B1 1/2019 Lewis et al.

FOREIGN PATENT DOCUMENTS

KR 200203893 Y1 * 12/2000
KR 20180002979 A * 1/2018

OTHER PUBLICATIONS

Swagers. Product Listing [online] Copyright 2021 [retrieved on Jun. 7, 20217]. Retrieved from the Internet: <URL: https://www.fenn-torin.com/metal-forming-machines/swagers/>.

(Continued)

*Primary Examiner* — Gregory D Swiatocha
(74) *Attorney, Agent, or Firm* — Cramer Patent & Design, PLLC; Aaron R. Cramer

(57) ABSTRACT

A square tubing swager is an electromechanically operated swaging machine for square steel tubing powered by an electric motor whose mechanical output is connected to a clutch assembly which operates an angle worm drive. The output of the angle drives dual two strand sprockets. These sprockets are connected through a series of roller chains and additional sprockets which drive four cam cross shafts. These cam shafts are set in four corresponding slide blocks assemblies within a jaw mount. The invention would be provided with various sized jaws for various sizes of square steel tubing. During use, the steel stock is inserted within the jaw area and the motor energized. The jaws then form the steel stock inward allowing the deformed area to be inserted within the hollow cavity of undeformed steel stock of the same size.

16 Claims, 7 Drawing Sheets

(56) References Cited

OTHER PUBLICATIONS

Tube Swaging Machine. Product Listing [online]. Copyright © 2005—2022 ETW International [retrieved on Jun. 7, 2021]. Retrieved from the Internet: <URL: http://rollforming-line.com/3-Tube-Swaging.html>.

Square swage | Proto-1 Manufacturing. Video [online]. YouTube.com by Proto-1 Manufacturing [retrieved on Jun. 7, 2021]. Retrieved from the Internet: <URL: https://www.youtube.com/watch?v=LplqgzefJYU>.

* cited by examiner

SQUARE TUBING SWAGER

RELATED APPLICATIONS

None.

FIELD OF THE INVENTION

The presently disclosed subject matter is directed to a tubing swager and more specifically to a square tubing swager.

BACKGROUND OF THE INVENTION

As anyone who performs a lot of physical work will attest, nothing beats having the proper tool for a job. The proper tool can save time, save money, produce a higher quality job, reduce damage to equipment, and provide for the increased safety of the worker. Each field of physical work has its own type of specialty tools, each performing a specialized task. One tool that is used in a wide variety of projects is that of the tubing swager. Such swagers may be used to compress metal tubing inward allowing the compressed inward, thus fitting within another section of similar, but uncompressed tubing. Such swagers are typically powered by a hydraulic pump and are normally used on round tubing.

While square tubing swagers do exist, they are less common. They are also heavy and cumbersome, making them difficult to use in field work. Finally, they are noisy to operate. Accordingly, there exists a need for a means by which a square tubing swager can be developed to address the above-mentioned issues. The development of the Square Tubing Swager fulfills this need.

SUMMARY OF THE INVENTION

The principles of the present invention provide for a square tubing swaging device having a base which has a first side and a second side, an electric drive motor which is disposed on the first side of the base, a clutch assembly which is connected to a rotational output of the electric drive motor, a control panel which converts a plurality of AC voltage to one-hundred-eighty volts, an angle worm drive which is connected to the rotational output of the clutch assembly, a swaging head which receives a reduced rotational speed and higher torque when delivered by a front primary drive chain, a front secondary drive chain which is adapted to communicate rotational power to a plurality of swager units—the swager units is a sliding block primary jaw mount, a rear primary drive chain which connects the angle worm drive and the swaging head, while a rear secondary drive chain connects the swager units located in the swaging head, and a first proximity switch and a second proximity switch which is adapted to be accessed by a user.

The electric drive motor may be operated by a plurality of direct current. The direct current may have a voltage rating of one-hundred-eighty volts. The electric drive motor may have an input voltage of two hundred twenty to two hundred forty volts. The clutch assembly may allow the electric drive motor to operated continuously, eliminating intermittent startups and braked stops during operation achieving a higher production rate. The control panel may provide for conditioning, transformation, rectification, and control of the electrical power to allow for controlled operation of the electric drive motor. The control panel may include a programmable logic controller. The angle worm drive may include a sixty-to-one gear ratio and a double shaft output.

The motion of the front primary drive chain is from a front primary chain travel path, while motion of the front secondary drive chain is along a front secondary chain travel path. The mechanical connection to the front primary chain travel path and the front secondary chain travel path may be made by a set of sprockets. The swager units may include four swager units. The four swager units may include a jaw arrangement for swaging square steel tubing.

The sliding block primary jaw mount may include a pair of bearing blocks. The pair of bearing blocks are powered by an eccentric cross shaft which is connected to the sprockets and the front secondary drive chain. There may be a simultaneous connection to the rear secondary drive chain. The rotational action of the eccentric cross shaft may produce a reciprocating action on the sliding block primary jaw mount. The rear primary drive chain may travel along a rear primary chain travel path, while correspondingly the rear secondary drive chain travels along the rear secondary chain travel path.

The square tubing swaging device may be an electromechanically-operated swaging machine for the square steel tubing. The square tubing swaging device may be bench mounted. The square tubing swaging device may be cart mounted.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
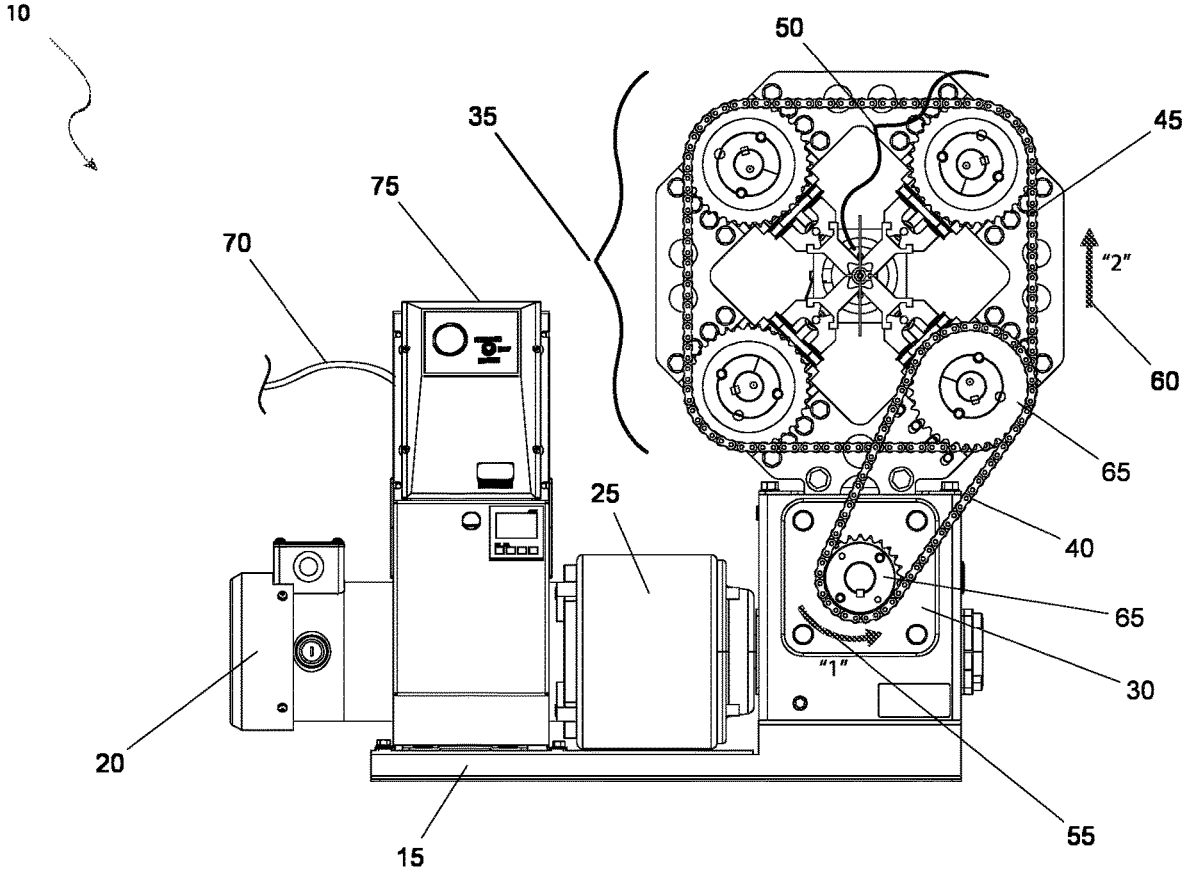
FIG. 1 is a front view of the square tubing swaging device, according to the preferred embodiment of the present invention.

10 square tubing swaging device
15 base
20 electric drive motor
25 clutch assembly
30 angle worm drive
35 swaging head
40 front primary drive chain
45 front secondary drive chain
50 swager unit
55 front primary chain travel path "1"
60 front secondary chain travel path "2"

65 sprocket
70 power cable
75 control panel
80 rear primary drive chain
85 rear secondary drive chain
90 rear primary chain travel path "3"
95 rear secondary chain travel path "4"'
96 first proximity switch
97 second proximity switch
100 tubing entrance path "a"
105 swager frame
110 tubing depth stop
115 sliding block primary jaw mount
120 bearing block
125 eccentric cross shaft
130 reciprocating action "r"
135 secondary jaw mount
140 adjuster
141 adjuster body
142 band
143 post
144 pulley
145 jaw
150 breaker edge
151 frame plate
152 mounting flange
153 bearing block bolt
154 bearing bolt slot
155 swaged square steel tube
156 shear lugs
157 slotted cut
160 swaged area
165 square steel tubing
170 tubing wall
175 swage length "L"
180 tubing width "W"

DESCRIPTION OF THE PREFERRED EMBODIMENTS

The best mode for carrying out the invention is presented in terms of its preferred embodiment, herein depicted within FIGS. 1 through 7. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. Detailed Description of the Figures

Referring now to FIG. 1, a front view of the square tubing swaging device 10, according to the preferred embodiment of the present invention is disclosed. The square tubing swaging device (herein also described as the "device") 10, comprises an electromechanically-operated swaging machine for square steel tubing 165. The device 10 is provided with a base 15 in which all operating and safety components of the device 10 are directly or indirectly mechanically coupled. The overall dimensions of the device 10 are approximately twenty-nine and one-half inches (29½ in.) wide, twenty-five-point-eleven inches (25.11 in.) tall and eleven-point-twenty-six inches (11.26 in.) deep. An electric drive motor 20 is located on the left side of the base 15. The electric drive motor 20 is envisioned to be operated by direct current with a voltage rating of one-hundred-eighty volts (180-VDC). Its rotational output is connected to a clutch assembly 25. The input voltage is two hundred twenty/two hundred forty volts (220/240-VAC). The AC voltage is converted to one-hundred-eighty volts (180-VDC) by the control panel 75. The clutch assembly 25 allows the electric drive motor 20 to operated continuously, eliminating intermittent startups and braked stops, during operation of the device 10. As such, a higher production rate is achieved. The rotational output of the clutch assembly 25 is connected to an angle worm drive 30. The angle worm drive 30 is envisioned to be provided with a sixty-to-one (60:1) gear ratio and a double shaft output. Thus, reduced rotational speed and higher torque is then delivered to a swaging head 35 by a front primary drive chain 40. A front secondary drive chain 45 then communicates rotational power to four (4) swager units 50. The swager units 50 will be described in greater detail herein below. It is appreciated that other features associated with the square tubing swaging device, such as shrouds or other safety equipment, that would commonly or expected to be used, are removed due to constraints of illustrations and to highlight the features described herein.

Motion of the front primary drive chain 40 is described by a front primary chain travel path "1" 55, while motion of the front secondary drive chain 45 is defined by a front secondary chain travel path "2" 60. Mechanical connection to the front primary chain travel path "1" 55 and the front secondary chain travel path "2" 60 are made by a set of sprockets 65. Electrical input power to the device 10 is provided by a power cable 70 to a control panel 75. The control panel 75 provides for conditioning, transformation, rectification, and control of the electrical power to allow for controlled operation of the electric drive motor 20. The method of control is envisioned to be a programmable logic controller (PLC). However, other methods of control, included but not limit to hardwire control, relay logic, single board computer (SBC) and other methods of control may also be utilized. As such, the exact method of control used with the device 10 is not intended to be a limiting factor of the present invention. The device 10 is envisioned for bench mounting or cart mounting.

Figure 2:
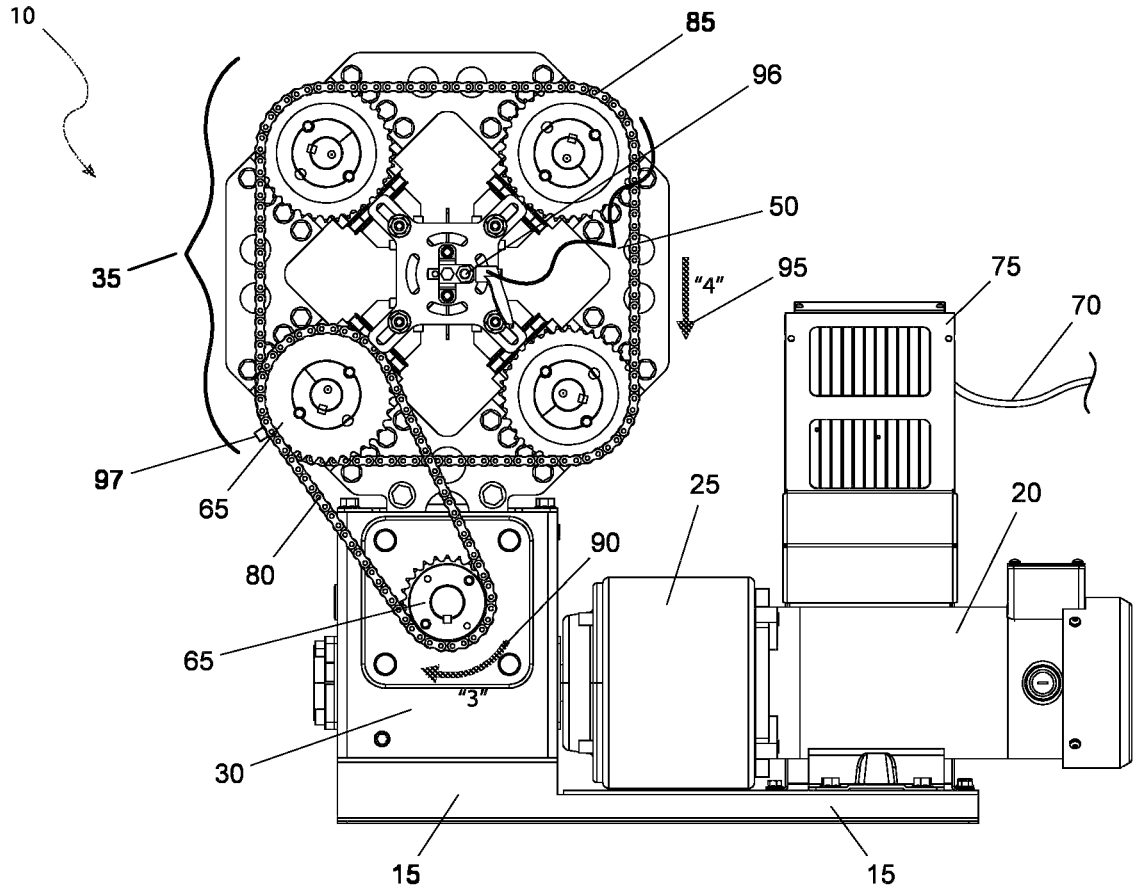
FIG. 2 is a rear view of the square tubing swaging device, according to the preferred embodiment of the present invention.

Referring next to FIG. 2, a rear view of the device 10, according to the preferred embodiment of the present invention is depicted. This view provides additional information on the physical, mechanical, and electrical relationship between the base 15, the electric drive motor 20, the clutch assembly 25, the angle worm drive 30, the swaging head 35, the swager units 50, additional sprockets 65, the power cable 70, and the control panel 75. A rear primary drive chain 80 connects the angle worm drive 30 the swaging head 35, while a rear secondary drive chain 85 connects the swager units 50 located in the swaging head 35. The rear primary drive chain 80 travels along a rear primary chain travel path "3" 90, while correspondingly the rear secondary drive chain 85 travels along the rear secondary chain travel path "4" 95. The four (4) swager units 50 comprise a "jaw arrangement" for the purposes of swaging square steel tubing 165 as will be described in greater detail herein below. A first proximity switch 96 and a second proximity switch 97 are provided as shown which provide input signals to the control panel 75 for purposes of operation. Further description of the operation of the first proximity switch 96 and the second proximity switch 97 will be provided herein below.

Figure 3:
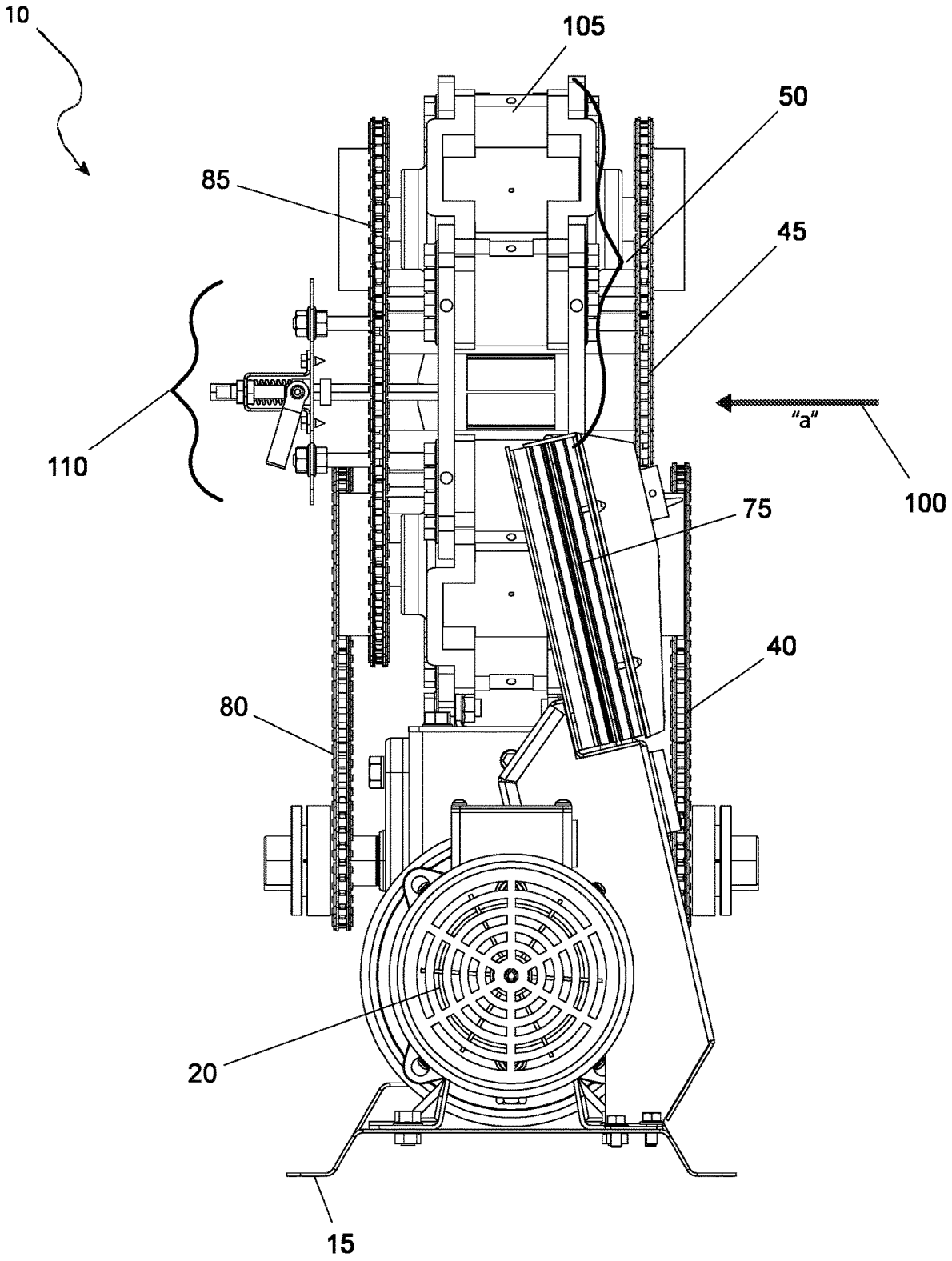
FIG. 3 is left end view of the square tubing swaging device, according to the preferred embodiment of the present invention.

Referring now to FIG. 3, a left end view of the device 10, according to the preferred embodiment of the present invention is shown. As before, the base 15, the electric drive motor 20, and the control panel 75 are readily visible. This view also discloses the front primary drive chain 40, the front secondary drive chain 45, the rear primary drive chain 80, and the rear secondary drive chain 85 simultaneously visible. Square steel tubing 165 enters along a tubing entrance path "a" 100. The four (4) swager units 50 are mounted on a swager frame 105. A tubing depth stop 110 aids in consistent placement of the square steel tubing 165.

Figure 4:
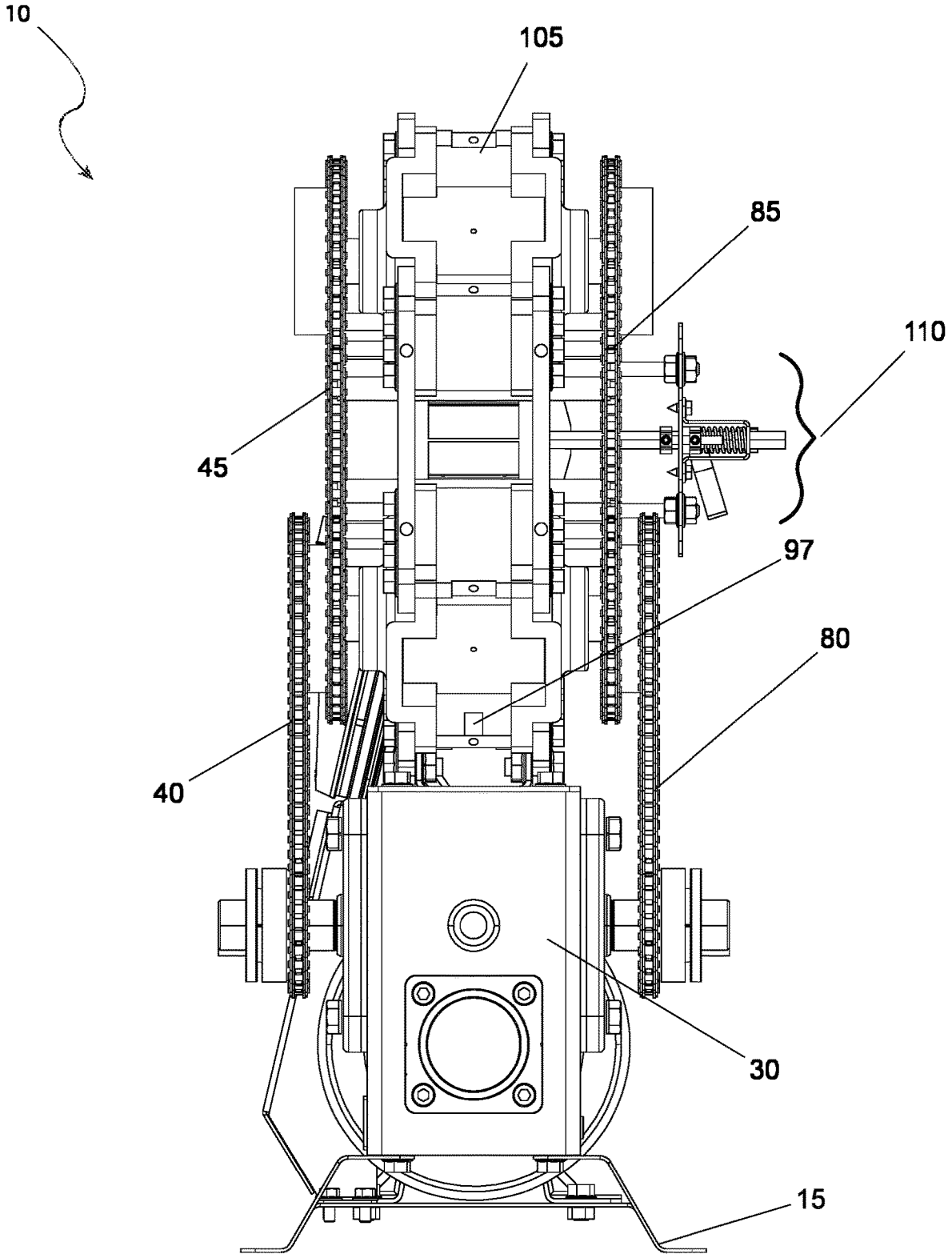
FIG. 4 is a right end view of the square tubing swaging device, according to the preferred embodiment of the present invention.

Referring next to FIG. 4, a right end view of the device 10, according to the preferred embodiment of the present invention is disclosed. This view provides clarification on the base 15, the angle worm drive 30, the front primary drive chain 40, the front secondary drive chain 45, the rear primary drive chain 80, the rear secondary drive chain 85, the swager frame 105, and the tubing depth stop 110. The first proximity switch 96 and the second proximity switch 97 remain visible in this view as well.

Figure 5:
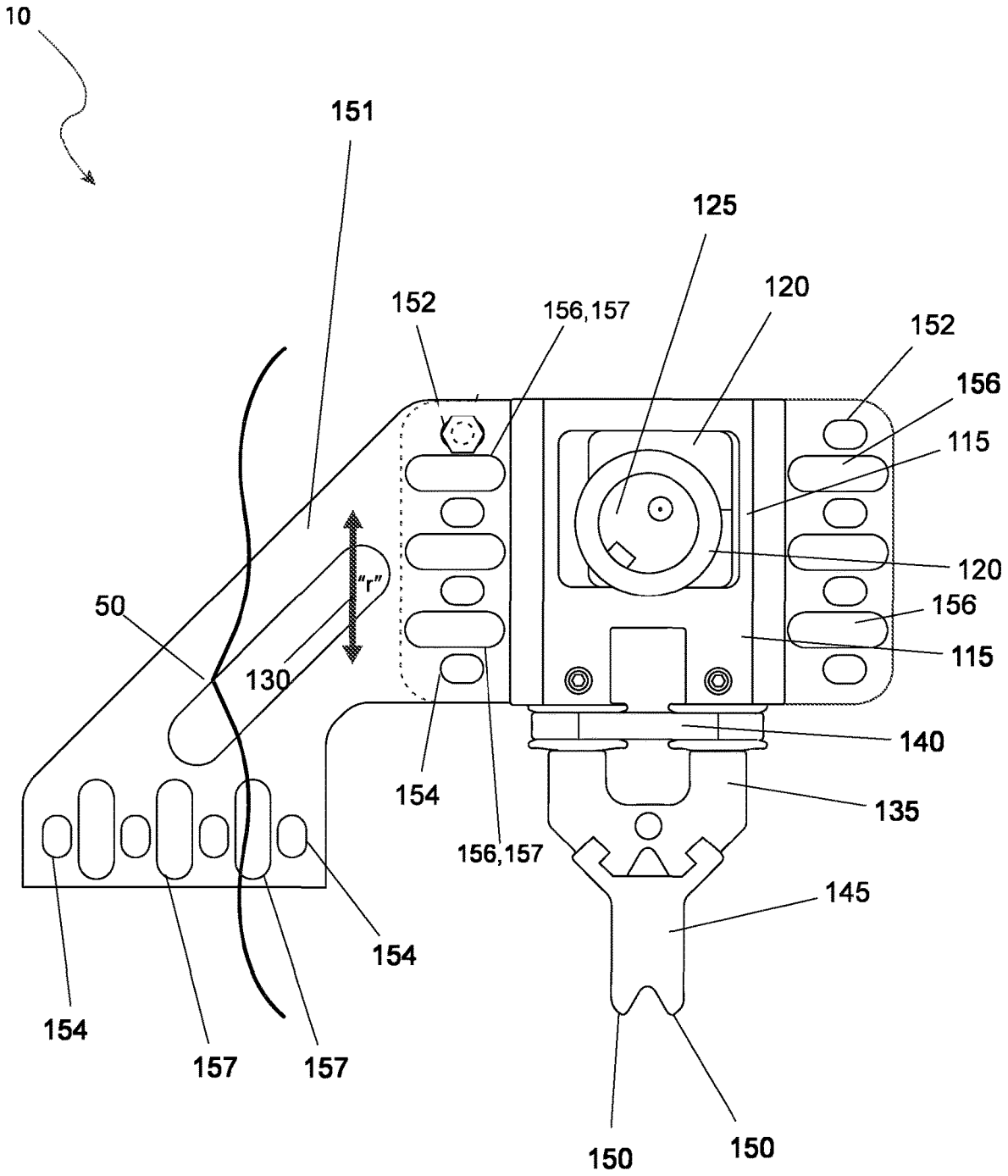
FIG. 5 is a detail view of the swager units, as used with the square tubing swaging device, according to the preferred embodiment of the present invention.

Referring now to FIG. 5, a detail view of the swager units 50, as used with the device 10, according to the preferred embodiment of the present invention is depicted. The primary component of the swager units 50 is the sliding block primary jaw mount 115. The sliding block primary jaw mount 115 contains two (2) sets of bearing blocks 120 (of which only one (1) is shown due to illustrative limitations. The bearing blocks 120 are powered by an eccentric cross shaft 125 which is connected to the sprockets 65 (as shown in FIG. 1) and thus the front secondary drive chain 45 (as shown in FIG. 1), along with a simultaneous connection to the rear secondary drive chain 85 (as shown in FIG. 2). Rotational action of the eccentric cross shaft 125 thus produces a reciprocating action "r" 130 on the sliding block primary jaw mount 115. The resultant reciprocating action "r" 130 is then transmitted to a secondary jaw mount 135 via an adjuster 140 which allows for adjustment due to misalignment of the four (4) swager units 50. A jaw 145 is mounted on the distal end of the secondary jaw mount 135 from the sliding block primary jaw mount 115. Each jaw 145 is provided with breaker edges 150 along its contact face. Further explanation of the breaker edges 150 will be provided herein below.

The swaging process is controlled by the simultaneous movement of the jaws 145. Each corner edge of the square steel tubing 165 is held in the jaws 145 as it goes through its cycle of compression. This gives the swage the desired symmetrical shape. As the swager units 50 experience large amounts of pressure during operation, additional reinforcement against shearing of the bearing blocks 120 is provided by a frame plate 151. Each frame plate 151 is in mechanical communication with an individual bearing block 120 using a mounting flange 152, located on either side of the bearing block 120. Each frame plate 151 is secured by four (4) bearing block bolts 153 per side for a total of eight (8) per frame plate 151 and sixteen (16) per each bearing block 120 and two (2) frame plates 151. Note that only one (1) bearing block bolt 153 is shown for illustrative simplicity. The mounting flanges 152 and the frame plate 151 are provided with bearing bolt slots 154 to accommodate the bearing block bolts 153. To further shear strength, each mounting flange 152 on the bearing blocks 120 is provided with multiple shear lugs 156 protruding from its front face. The shear lugs 156 are in mechanical communication with slotted cuts 157 on the frame plate 151.

Figure 6:
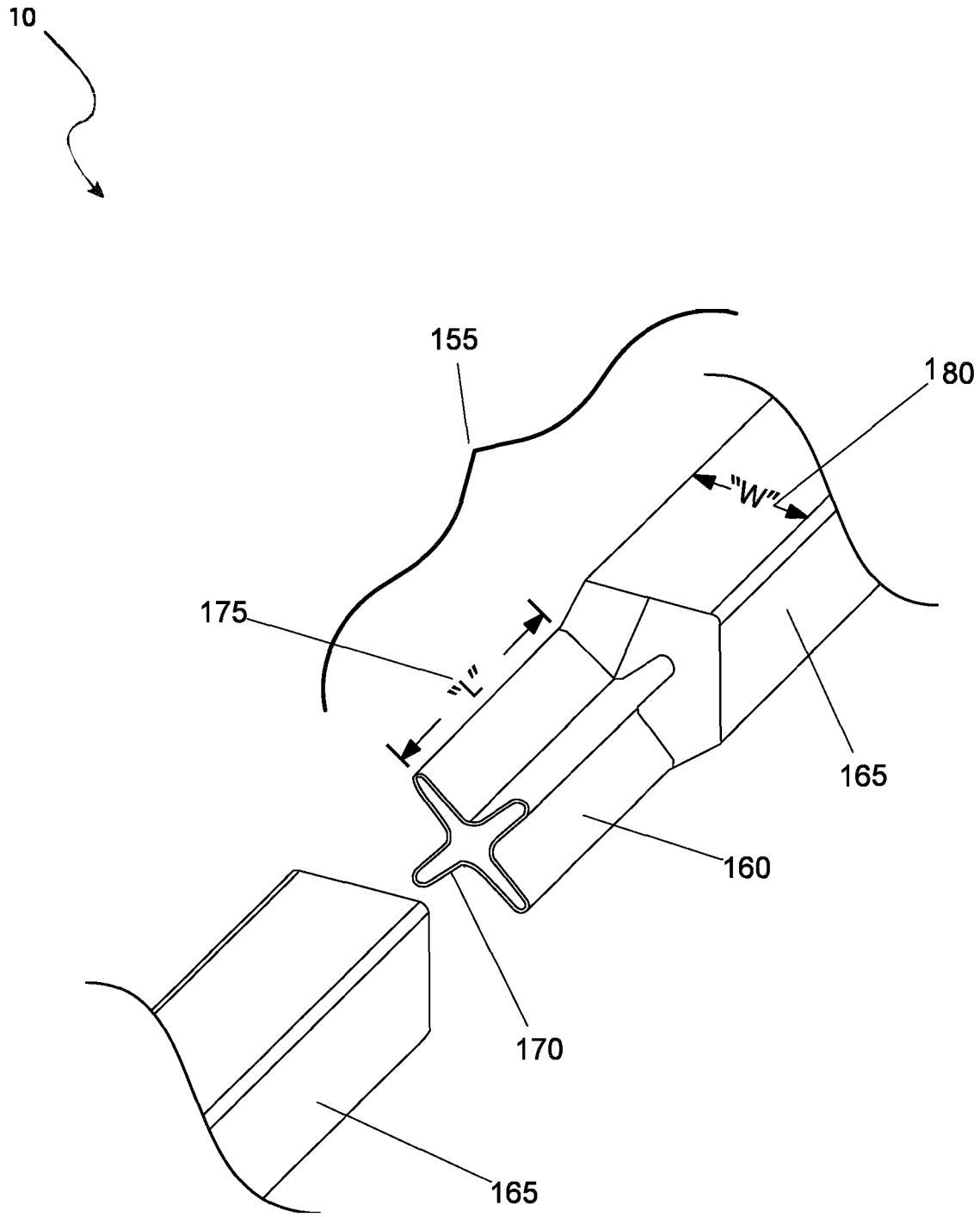
FIG. 6 is a pictorial view of the swaged square steel tube, as produced by the square tubing swaging device, according to the preferred embodiment of the present invention.

Referring to FIG. 6, a pictorial view of a swaged square steel tube 155, as produced by the square tubing swaging device 10, according to the preferred embodiment of the present invention is shown. A swaged area 160 is produced at the end of a square steel tube 165. The swaged area 160 is produced by the jaws 145 (as shown in FIG. 5). The breaker edges 150 (as shown in FIG. 5) cause the tubing wall 170 to break toward the center of the square steel tube 165, while lessening the required force to initiate the swaging process. The swage length "L" 175 is twice the tubing width "W" 180. For example, a square steel tube 165 with a tubing width "W" 180 of one inch (1 in.) tube would produce a swage length "L" 175 of two inches (2 in.). The device 10 is designed for use with a tubing wall 170 of sixty-five thousandths of an inch (0.065 in.) wall or "light wall" tubing. The mechanical technique incorporated could be applied to a heavier tubing wall 170 by correspondingly increasing the size of the components of the device 10. Square steel tube 165 with a tubing width "W" 180 of up to four inches (4 in.) can be swaged in the device 10.

Figure 7:
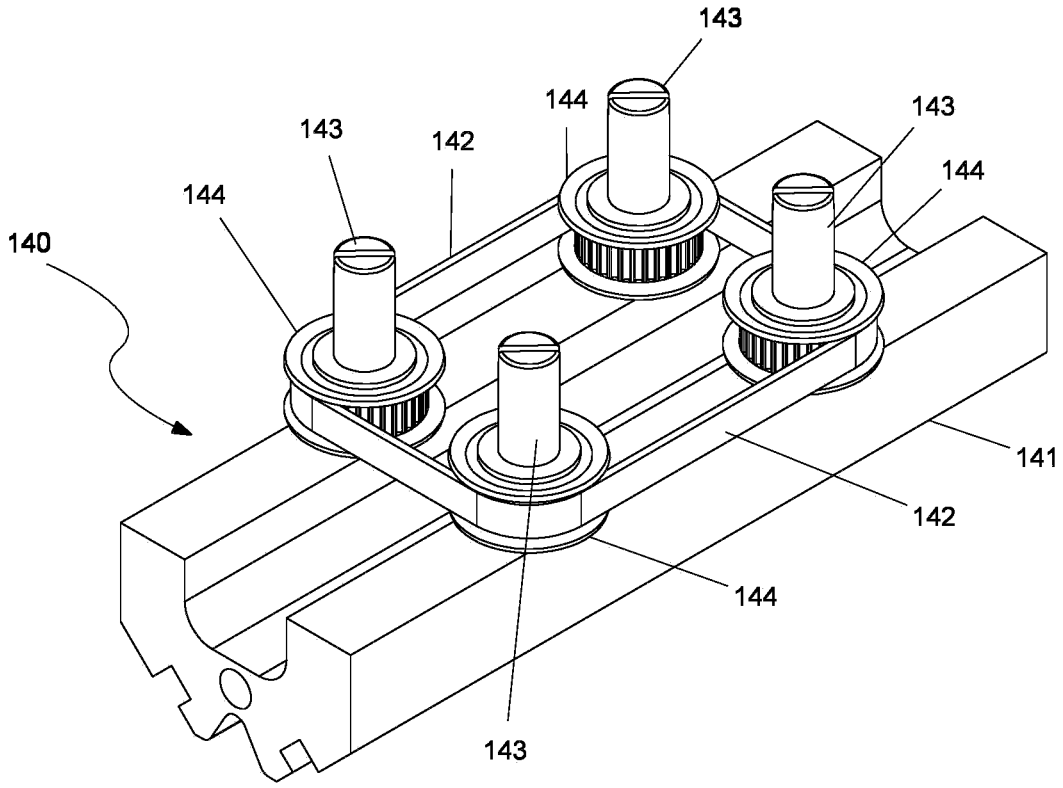
FIG. 7 is a perspective view of the jaw adjuster, as used with the square tubing swaging device, according to the preferred embodiment of the present invention.

Referring now to FIG. 7, which illustrates the adjuster 140, is herein disclosed. The adjuster 140 comprises an adjuster body 141 with a first side configured to engage the and a second side. A plurality of posts 143 are located on the second side of the adjuster body 141 and extend away therefrom. Each post 143 is rotatably fastened to the adjuster body 141. Each post 143 has a driver engagement feature to enable a driving unit, such as a screwdriver or other similar device, to enable the driving unit to engage and drive the adjuster body 141 relative to the jaws 145. Each post 143 has a pulley 144 rotatably engaged thereto. The pulleys 144 are in mechanical communication each other with a band 142 that enables driving of a single post 143 to transfer the rotational motion to all posts 143 so that the adjuster body 141 is uniformly moved.

2. Operation of the Preferred Embodiment

The preferred embodiment of the present invention can be utilized by the common user in a simple and effortless manner with little or no training. It is envisioned that the square tubing swaging device 10 would be constructed in general accordance with FIG. 1 through FIG. 6. The user would procure the device 10 from conventional procurement channels such as hardware stores, home improvement stores, mechanical supply houses, mail order and internet supply houses and the like. Special attention would be paid to the overall tubing width "W" 180 and tubing wall 170 size of the square steel tube 165 to be used with the device 10.

After procurement and prior to utilization, the device 10 would be prepared in the following manner: the base 15 would be placed on a suitable work surface; the power cable 70 would be connected to an appropriate power source; the tubing depth stop 110 would be set to the desired depth to produce a desired swage length "L" 175; the appropriate swager units 50 would be selected and adjusted via the adjuster 140 to produce the desired swaged area 160. At this point in time, the device 10 is ready for use.

During utilization of the device 10, the following procedure would be initiated: the electric drive motor 20 would be energized via the control panel 75 and placed in a standby state with the clutch assembly 25 disengaged; square steel tube 165 would be inserted along the tubing entrance path "a" 100 until contacting the tubing depth stop 110; said placement closes a first proximity switch 96 electrically associated with the control panel 75; the clutch assembly 25 is then engaged, allowing rotational energy to operate the angle worm drive 30, the sprockets 65, the front primary drive chain 40, the front secondary drive chain 45, the rear primary chain travel path "3" 90, and the rear secondary chain travel path "4" 95; the sprockets 65 operate the eccentric cross shaft 125, thus forcing the secondary jaw mount 135 inward along with the jaws 145; the breaker edges 150 on the jaws 145 contact the square steel tube 165 and produce the swaged area 160; the second proximity switch 97 positions the jaws 145 in an open state when the square steel tube 165 with the swaged square steel tube 155 fabrication is removed; and, the jaws 145, remaining open for subsequent usage.

After the swaged area 160 is produced, the swaged area 160 may be inserted in an open square steel tube 165 to produce a joint. This joint allows for semipermanent joints, or joints that are connected by welding or fasteners that are stronger.

The features of the device 10 are envisioned to produce the following benefits: as the device 10 is powered by electricity and not hydraulic power, the device 10 is simpler in design, quieter in operation, and can be more easily transported for use in the field. The joints produced by the device 10 produce a quick, non-welded, end to end connection, of two (2) square steel tubes of the same size. These joints may also be easily disconnected.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A square tubing swaging device, comprising:

a base having a first side and a second side;

an electric drive motor disposed on the first side of the base;

a clutch assembly connected to a rotational output of the electric drive motor;

a control panel converting an AC voltage to one-hundred-eighty volts DC;

an angle worm drive connected to the rotational output of the clutch assembly;

a swaging head having a plurality of swager units, the swaging head receiving reduced rotational speed and higher torque when delivered by a front primary drive chain;

a front secondary drive chain adapted to communicate rotational power to the swager units, the swager units each include a sliding block primary jaw mount;

a rear primary drive chain connecting the angle worm drive and the swaging head, while a rear secondary drive chain connects the swager units located in the swaging head; and a first proximity switch and a second proximity switch adapted to be accessed by a user;

wherein motion of the front primary drive chain is along a front primary chain travel path, while motion of the front secondary drive chain is along a front secondary chain travel path; and wherein mechanical connection to the front primary chain travel path and the front secondary chain travel path are made by a set of sprockets.

2. The square tubing swaging device, according to claim 1, wherein the electric drive motor is operated by direct current that has a voltage rating of one-hundred-eighty volts.

3. The square tubing swaging device, according to claim 1, wherein the electric drive motor has an input voltage of two hundred twenty to two hundred forty volts.

4. The square tubing swaging device, according to claim 1, wherein the clutch assembly allows the electric drive motor to operated continuously, eliminating intermittent startups and braked stops during operation achieving a higher production rate.

5. The square tubing swaging device, according to claim 1, wherein the control panel provides for conditioning, transformation, rectification, and control of the AC voltage to allow for controlled operation of the electric drive motor.

6. The square tubing swaging device, according to claim 1, wherein the control panel includes a programmable logic controller.

7. The square tubing swaging device, according to claim 1, wherein the angle worm drive includes a sixty-to-one gear ratio and a double shaft output.

8. The square tubing swaging device, according to claim 1, wherein the swager units include four swager units.

9. The square tubing swaging device, according to claim 8, wherein the four swager units include a jaw arrangement for swaging square steel tubing.

10. The square tubing swaging device, according to claim 1, wherein the sliding block primary jaw mount includes a pair of bearing blocks.

11. The square tubing swaging device, according to claim 10, wherein the pair of bearing blocks are powered by an eccentric cross shaft which is connected to the set of sprockets and the front secondary drive chain.

12. The square tubing swaging device, according to claim 11, wherein rotational action of the eccentric cross shaft produces a reciprocating action on the sliding block primary jaw mount.

13. The square tubing swaging device, according to claim 1, wherein the rear primary drive chain travels along a rear primary chain travel path, while correspondingly the rear secondary drive chain travels along the rear secondary chain travel path.

14. The square tubing swaging device, according to claim 1, wherein the square tubing swaging device is an electro-mechanically operated swaging machine for square steel tubing.

15. The square tubing swaging device, according to claim 1, wherein the square tubing swaging device is bench mounted.

16. The square tubing swaging device, according to claim 1, wherein the square tubing swaging device is cart mounted.

* * * * *